US005769573A

United States Patent [19]

Faas et al.

[11] Patent Number: 5,769,573

[45] Date of Patent: Jun. 23, 1998

[54] APPARATUS FOR CONTROLLING AIR FLOW IN AN AIR DUCT

[75] Inventors: Jürg Faas, Dinhard; Peter Brütsch, Neuhausen, both of Switzerland

[73] Assignee: Rieter Machine Works, Ltd., Winterthur, Switzerland

[21] Appl. No.: 305,428

[22] Filed: Sep. 13, 1994

Related U.S. Application Data

[63] Continuation of Ser. No. 41,679, Apr. 1, 1993, abandoned.

[30] Foreign Application Priority Data

Apr. 1, 1992 [CH] Switzerland ..... 01 047/92-8

[51] Int. Cl.[6] ..... B65G 53/60

[52] U.S. Cl. ..... 406/171; 406/70; 19/105; 137/513.5; 137/527.8

[58] Field of Search ..... 19/97.5, 105; 137/513.5, 137/527.8; 406/70, 171, 172, 175

[56] References Cited

U.S. PATENT DOCUMENTS

| | | | |
|---|---|---|---|
| 3,580,644 | 5/1971 | Ballard | 406/171 X |
| 4,141,380 | 2/1979 | Lenk | 137/513.5 |
| 4,878,784 | 11/1989 | Binder et al. | 406/171 X |

FOREIGN PATENT DOCUMENTS

| | | |
|---|---|---|
| 0341450 | 11/1989 | European Pat. Off. . |
| 1273589 | 9/1961 | France . |
| 729040 | 12/1942 | Germany . |
| 1256119 | 12/1967 | Germany . |
| 3734140 | 4/1989 | Germany . |

*Primary Examiner*—Andrew C. Pike

*Attorney, Agent, or Firm*—McAulay Fisher Nissen Goldberg & Kiel, LLP

[57] ABSTRACT

A throttle valve is provided within a discharge air duct located adjacent a fiber duct receiving a fiber laden air stream. The throttle valve cooperates with a stop in a lowered position to form a gap to allow a minimal air flow therethrough. In addition, a weight is provided on an arm attached to the throttle valve for pivoting therewith. The weight is disposed to counterbalance a substantial portion of the weight of the flap valve in the raised position of the valve so that the air flow maintains the valve in the open condition.

18 Claims, 1 Drawing Sheet

APPARATUS FOR CONTROLLING AIR FLOW IN AN AIR DUCT

Figure 1:
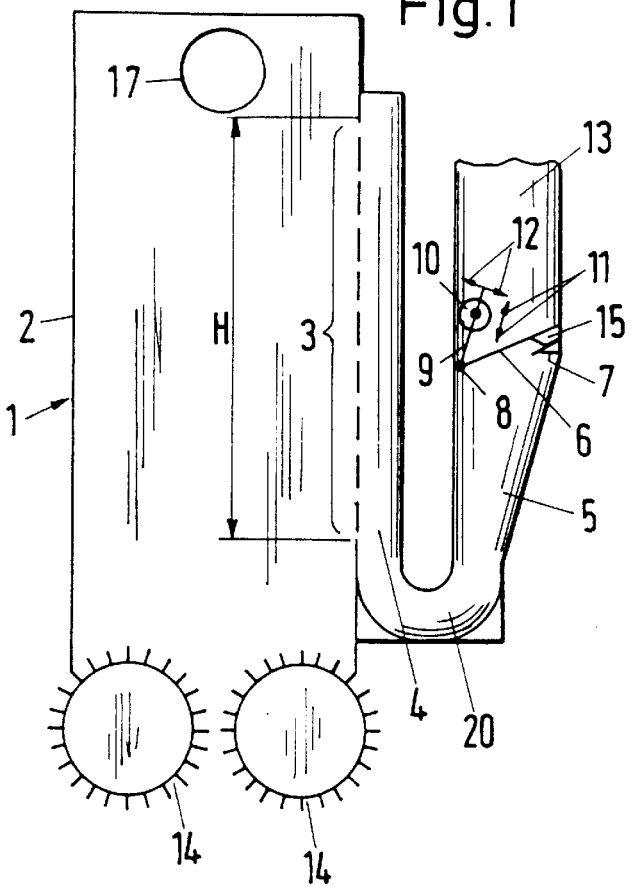

This is a continuation of application Ser. No. 08/041,679, filed on Apr. 1, 1993, now abandoned.

This invention relates to an apparatus for controlling an airflow in an air duct. More particularly, this invention relates to an apparatus for controlling the flow of air from a fiber containing chute of a textile machine.

As is known, various types of textile machines have been provided with conveying devices for conveying fiber in a pneumatic manner. Such systems have been known, for example, from European Patent Application 0341450 and French Patent 1,273,589. In such cases, use has been made of vertically disposed chutes or air ducts to receive a stream of fiber-laden air. Typically, at least one wall of the chute has been provided with slots, perforations, or the like in order to be permeable to the air flow while at the same time retaining the fiber within the chute. The retained fiber can then be accumulated and delivered via various delivery means to subsequent stations of the textile machine.

The air which is exhausted from the chute is generally exhausted into a collection of air ducts. In some cases, the air duct simply directs the air in a predetermined direction into the atmosphere or is connected to a suction ventilator which conveys the air via a respective conduit to a desired location.

However, such collection air ducts have a disadvantage because, without controlling the discharge air pressure, the compression of the fibers within the chute becomes different depending upon the filling height of the fiber within the chute. This, in turn, has an influence on the evenness of the fiber layer which is delivered out of the chute. In addition, since the unevenness is known to continue during the treatment of the fibers within a blow room and a carding room, regulating measures are required in order to compensate for the unevenness in the fiber layer.

Accordingly, it is an object of the invention to control the flow of air through an exhaust air duct to attain the highest possible evenness in the discharge air pressure.

It is another object of the invention to be able to control the air flow of air exhausted from a fiber receiving chute in a substantially maintenance free manner.

Briefly, the invention is directed to a discharge air duct for conveying an upward flow of air, for example, air which has been obtained from a fiber duct which has received a fiber laden pressurized air stream.

In accordance with the invention, a stop is disposed in the air duct and a throttle valve for throttling the flow of air in the duct is pivotally mounted on a pivot axis for pivoting within the duct between a lowered position resting on the stop and a raised position spaced from the stop. In addition, at least one of the stop and the valve defines a gap between the stop and valve when the valve is in the lowered position in order to allow a minimum of air flow therethrough.

Still further, the invention provides an arm which is disposed outside the duct and which is connected to the valve for pivoting therewith about the pivot axis as well as a weight which is adjustably mounted on and along the arm.

The valve and weight are constructed such that the valve has a torque about the pivot axis which is greater than the torque of the weight about the pivot axis for all positions of the weight along the arm. When the valve is in the lowered position, the weight is also disposed on the same side of the pivot axis as the valve. However, when the valve is in the raised position, the weight is positioned on the opposite side of the pivot axis. In this way, the weight influences the valve to remain in the raised position. In addition, the torque of the valve is of a magnitude which exceeds the torque of the weight by an amount equal to a static pressure in the duct, for example, 20 millimeters of water column. Typically, the torque of the valve exceed the torque of the weight by an amount of from 10 to 50 Nmm.

In use, the throttle valve is used to close off the air duct to a flow of air when in the lowered position except for the minimal flow permitted through the gap between the valve and stop. Depending upon the air pressure of the air flow within the air duct, the throttle valve is lifted from the stop to a more or less degree. In this respect, the weight of the throttle valve and the weight on the arm act against the air flow pressure. However, when the valve has been moved to the fully raised position, the weight on the arm acts to retain the valve in the raised position so that the air pressure in the air flow can reduce to a lower value while the valve remains in the fully raised position.

In accordance with the invention, the fiber duct which receives the fiber laden air steam has an air permeable wall for exhausting air therethrough while retaining fiber within the duct. In addition, a suitable delivery means is provided at the lower end of the fiber duct for feeding a fiber wadding or the like from the duct. The air permeable wall further communicates with an air duct which receives the exhausted air in which, in turn, communicates via a pipe bend with the discharge air duct containing the throttle valve.

The arrangement is such that a low static pressure can be maintained in the discharge air duct via the throttle valve so that only a small pressure above atmospheric pressure is required in order to maintain an air flow through the fibers in the fiber duct. As a result, an even compaction of the fibers in the fiber duct can be achieved irrespective of the filling height of the fiber within the fiber duct.

Figure 5:
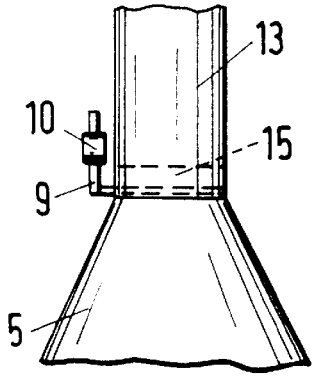
Figure 4:
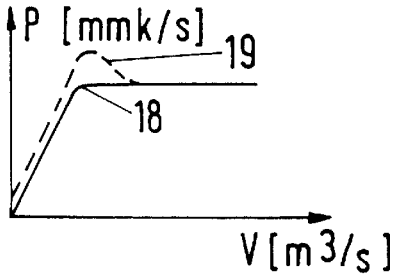
Figure 2:
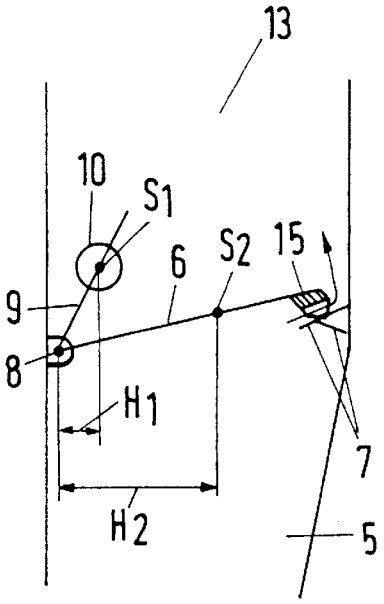
Figure 3:
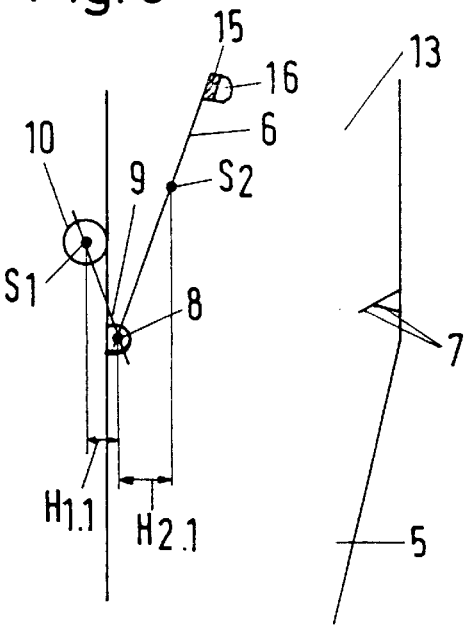

These and other objects and advantages of the invention will become more apparent from the following detailed description taken in conjunction with the accompanying drawings wherein:

FIG. 1 illustrates a side view of a fiber duct and discharge air duct constructed in accordance with the invention;

FIG. 2 schematically illustrates a view of the throttle valve in a lowered position on the stop in accordance with the invention;

FIG. 3 illustrates a view similar to FIG. 2 with the throttle valve in a raised position in accordance with the invention; and FIG. 4 graphically illustrates a pressure-volume flow curve of air through the discharge air duct in accordance with the invention; and FIG. 5 illustrates a partial view of the discharge air duct of FIG. 1 taken from a right-hand side as viewed.

Referring to FIG. 1, the fiber duct 1 is constructed for use in a textile machine so as to receive a fiber laden pressurized air stream from a suitable source via an inlet opening 17 at the upper end of the fiber duct 1. The duct 1 has a rectangular cross-sectional shape so as to have three solid walls 2 (only one of which is shown) which are substantially disposed at a right angle towards one another and an air permeable wall 3, for example, a wall provided with perforations over a height(H). The air permeable wall 3 is constructed to permit the exhaust of air therethrough while retaining fiber within the duct 1. In addition, a delivery means, for example, including a pair of delivery rollers 14, is located at the lower end of the fiber duct 1 for feeding a fiber wadding or the like from the duct 1 in known manner.

As illustrated, an air duct 4 is disposed to communicate with the permeable wall 3 so as to receive the air exhausted from the fiber duct 1. In addition, this air duct 4 communicates via a pipe bend 20 with a diffuser 5 which leads to a further discharge air duct 13. Both ducts 4, 13 are vertically disposed while the bend 20 is of U shape. Accordingly, the discharge air duct 13 is vertically disposed to receive an upward flow of air.

Referring to FIGS. 1 and 2, a throttle valve 6 is disposed within the discharge air duct 13 at the juncture of the diffuser 5 and discharge duct 13 for throttling the flow of air therethrough. As indicated, the valve 6 cooperates with a stop 7 which is disposed in a fixed position in the air duct 13.

As indicated in FIG. 2, the diffuser 5 is of diverging conical shape in the direction of the discharge duct 13 taken in one plane while, as shown in FIG. 1a, being of converging conical shape in the direction of the discharge duct 13 in a perpendicular plane.

Referring to FIG. 1, the throttle valve 6 is pivotally mounted on a pivot axis, for example, formed by an axle 8 mounted on suitable brackets within the discharge air duct 13 for pivoting within the duct 13 between a lowered substantially horizontal position as shown in FIG. 2 resting on the stop 7 and a raised position as shown in FIG. 3 spaced from the stop 7. As further indicated in FIG. 2, the valve 6 carries a tappet 15 which has a recess 16 to define a gap between the valve 6 and the stop 7 when the valve 6 is in the lowered position in order to allow a minimum air flow therethrough. Alternatively, the stop 7 may be provided with a suitable means to form a gap for the air flow.

Referring to FIGS. 1 and 5, an arm 9 is also provided on the axle 8 so as to be connected to the valve 6 in a fixed manner for pivoting with the valve 6 about the pivot axis in the direction of the arrows 12. As indicated in FIG. 5, the arm 9 is located outside the discharge duct 13. A weight 10 is adjustably mounted on and along the arm 9. As indicated in FIG. 1, the weight 10 is displaceable in the directions indicated by the arrows 11 along the arm 9. As indicated in FIG. 3, the weight 10 is positioned on a side of a vertical plane passing through the pivot axis of the axle 8 opposite the valve 6 when the valve 6 is in the fully raised position.

Referring to FIG. 2, the valve 6 has a center of gravity S2 which is spaced at a distance H2 from the pivot axis whereas the weight 10 has a center of gravity S1 which is spaced a lesser distance H1 from the pivot axis of the axle 8. Further, the weight of the throttle valve 6 and the weight of the arm 9 together with the slide weight 10 are selected in such a way that the torque of the throttle valve 6 (S2×H2) is greater than the torque of the weight 10 (S1×H1) about the pivot axis of the axle 8 for all positions of the weight 10 along the arm 9. In this respect, the torque of the valve 6 exceeds the torque of the weight 10 by an amount such that when the throttle valve 6 is opened, as shown in FIG. 3, there will be a near unstable balance of the throttle valve 6 and the arm 9 together with the weight 10. For example, the torque of the valve 6 exceeds the torque of the weight 10 by a relatively small amount, for example, between 10 and 50 Nmm so that even with only a slight impact pressure from the air flow, the throttle valve 6 is kept open. In the absence of an air flow, the valve 6 would close, that is move into the lowered position onto the stop 7 as indicated in FIG. 2.

As shown in FIG. 3, the valve 6 is in the fully opened position, the weight 10 is displaced a horizontal distance H1.1 to the left of the axis 8 and the center of gravity S2 of the throttle valve 6 is at a distance H2.1 to the right of the axis 8.

Preferably, the static pressure at the end of the diffuser 5 is selected to be 30 millimeters of water column and the torque ratio of the throttle valve 6 to the arm 9 and weight 10 is selected in such a way that the valve remains open at a static pressure of 20 millimeters of water column at the end of the diffuser 5.

The advantage of such a low static pressure resides in the fact that only a little pressure above atmospheric is required in the fiber duct in order to maintain an air flow through the fibers situated in the fiber duct 1 because a compaction of the fibers otherwise can only be achieved by air flowing through.

In the selection of the mentioned 30 millimeters of water column, the pressure differences due to the different filling of the fiber duct 1 are only minimal, that is, only a few millimeters of water column. This leads to the advantage of a substantially even compaction of the fibers in the fiber duct 1, substantially irrespective of the degree of filling.

Referring to FIG. 4, leaving a gap between the throttle valve 6 and the stop 7 in the lowered position of the valve 6, has an advantage in that during the opening of the valve 6, a pressure/volume flow curve 18, as illustrated, is achieved without the overshooting indicated by the dotted line curve 19.

Of note, the dimensions of the air duct 13 to achieve the above-mentioned 30 millimeters of water column have to be determined empirically and are not the subject matter of the present invention.

The invention thus provides an apparatus which is capable of maintaining an even compaction of the deposited fibers within a fiber duct despite changes in the filling height of the fibers in the duct. Further, the invention provides for a substantially even compression of fibers in a fiber duct wherein the fibers have been delivered to the duct pneumatically.

The invention further provides a throttle valve arrangement which can be opened by the air flow under very little air pressure while remaining open with the help of a small kinetic energy provided by a weighted arm.

What is claimed:

1. In combination, an air duct for conveying an upward flow of air therethrough;

a stop disposed in said air duct;

a throttle valve for throttling the flow of air in said duct, said valve being pivotally mounted on a pivot axis for pivoting within said duct between a lowered position resting on said stop and a raised position spaced from said stop;

at least one of said stop and said valve defining a gap between said stop and said valve with said valve in said lowered position to allow a minimum of air flow therethrough; and an arm connected to said valve for pivoting therewith about said pivot axis, said arm being disposed outside said duct.

2. The combination as set forth in claim 1 which further comprises a weight adjustable mounted on and along said arm and wherein said valve has a torque about said pivot axis greater than the torque of said weight about said axis for all positions of said weight along said arm.

3. The combination as set forth in claim 2 wherein said weight is positioned on one side of a vertical plane passing through said pivot axis opposite said valve with said valve in said raised position.

4. The combination as set forth in claim 2 wherein said torque of said valve exceeds said torque of said weight by an amount equal to a static pressure in said duct of 20 millimeters of water column.

5. The combination as set forth in claim 1 which further comprises a conically shaped diffuser extending from said air duct below said throttle valve for delivering the flow of air to said air duct.

6. The combination as set forth in claim 1 wherein said throttle valve is substantially horizontal in said lowered position.

7. In combination, a fiber duct for receiving a fiber laden pressurized air stream, said duct having an air permeable wall for exhausting air therethrough while retaining fiber within said duct;

delivering means at a lower end of said fiber duct for feeding a fiber wadding from said duct;

a first air duct communicating with said wall to receive the air exhausted from said fiber duct:

a second air duct communicating with said first air duct to receive an upward flow of the air therefrom;

a stop in said second air duct;

a throttle valve for throttling the flow of air in said second air duct, said valve being pivotally mounted on a pivot axis for pivoting within said second air duct between a lowered position resting on said stop and a raised position spaced from said stop;

at least one of said stop and said valve defining a gap between said stop and said valve with said valve in said lowered position to allow a minimum of air flow therethrough; and an arm connected to said valve for pivoting therewith about said pivot axis, arm being disposed outside air duct.

8. The combination as set forth in claim 7 which further comprises a pipe bend connected to and between said air ducts to convey the air flow therebetween.

9. The combination as set forth in claim 7 wherein said torque of said valve exceeds said torque of said weight by an amount of from 10 to 50 Nmm.

10. The combination as set forth in claim 7 wherein said throttle valve is disposed substantially horizontal in said lowered position.

11. The combination as set forth in claim 7 wherein said valve has a torque about said pivot axis greater than the torque of said weight about said axis for all positions of said weight along said arm.

12. The combination as set forth in claim 11 wherein said torque of said valve exceeds said torque of said weight by an amount equal to a static pressure in said duct of 20 millimeters of water column.

13. In combination, a fiber duct for receiving a fiber laden pressurized air stream, said duct having an air permeable wall for exhausting air therethrough while retaining fiber within said duct;

delivery means at a lower end of said fiber duct for feeding a fiber wadding from said duct;

a first air duct communicating with said wall to receive the air exhausted from said fiber duct;

a second air duct communicating with said first air duct to receive an upward flow of the air therefrom;

a stop in said second air duct;

a throttle valve for throttling the flow of air in said second air duct, said valve being pivotally mounted on a pivot axis for pivoting within said second air duct between a lowered position resting on said stop and a raised position spaced from said stop; and at least one of said stop and said valve having means to allow a minimum air flow therethrough with said valve in said lowered position.

14. The combination as set forth in claim 13 which further includes an arm connected to said valve for pivoting therewith about said pivot axis, said arm being disposed outside said second air duct.

15. In combination, a fiber duct for receiving a fiber laden pressurized air stream, said duct having an air permeable wall for exhausting air therethrough while retaining fiber within said duct;

delivery means at a lower end of said fiber duct for feeding a fiber wadding from said duct;

a first air duct communicating with said wall to receive the air exhausted from said fiber duct;

a second air duct communicating with said first air duct to receive a flow of the air therefrom;

a stop in said second air duct;

a throttle valve for throttling the flow of air in said second air duct, said valve being pivotally mounted on a pivot axis for pivoting within said second air duct between a first position resting on said stop and a second position spaced from said stop; and at least one of said stop and said valve having means to allow a minimum air flow in said second air duct with said valve in said first position to maintain an air flow through the fiber in said fiber duct.

16. The combination as set forth in claim 15 which further includes an arm connected to said valve for pivoting therewith about said pivot axis, said arm being disposed outside said second air duct.

17. In combination, an air duct for conveying an upward flow of air therethrough;

a stop disposed in said air duct;

a throttle valve for throttling the flow of air in said duct, said valve being pivotally mounted on a pivot axis for pivoting within said duct between a first position resting on said stop and a second position spaced from said stop; and at least one of said stop and said valve defining a gap between said stop and said valve with said valve in said first position to allow a minimum of air flow therethrough.

18. In combination, a fiber duct for receiving a fiber laden pressurized air stream, said duct having an air permeable wall for exhausting air therethrough while retaining fiber within said duct;

delivering means at a lower end of said fiber duct for feeding a fiber wadding from said duct;

a first air duct communicating with said wall to receive the air exhausted from said fiber duct;

a second air duct communicating with said first air duct to receive a flow of the air therefrom;

a stop in said second air duct;

a throttle valve for throttling the flow of air in said second air duct, said valve being pivotally mounted on a pivot axis for pivoting within said second air duct between a first position resting on said stop and a second position spaced from said stop; and at least one of said stop and said valve defining a gap between said stop and said valve with said valve in said first position to allow a minimum of air flow therethrough.

* * * * *

UNITED STATES PATENT AND TRADEMARK OFFICE

CERTIFICATE OF CORRECTION

PATENT NO. : 5,769,573

DATED : June 23, 1998

INVENTOR(S) : Jürg Faas, et al

It is certified that error appears in the above-identified patent and that said Letters Patent is hereby corrected as shown below:

Column 5, line 29, after "outside" insert -said second-

Signed and Sealed this

Twenty-second Day of September, 1998

*Attest:*

Bruce Lehman

BRUCE LEHMAN

*Attesting Officer*

*Commissioner of Patents and Trademarks*